US005810252A

United States Patent [19]

Pennamen et al.

[11] Patent Number: 5,810,252

[45] Date of Patent: Sep. 22, 1998

[54] METHOD AND APPARATUS FOR ATOMIZING A LIQUID, PARTICULARLY A HIGHLY VISCOUS LIQUID, WITH THE AID OF AT LEAST ONE AUXILIARY GAS

[75] Inventors: Yannick Pennamen, Etienne du Rouvray; Didier Quevillon, Turretot, both of France

[73] Assignee: Total Raffinage Distribution, S.A., Puteaux, France

[21] Appl. No.: 402,871

[22] Filed: Mar. 13, 1995

[30] Foreign Application Priority Data

Mar. 11, 1994 [FR] France ..... 94 02825

[51] Int. Cl.[6] ..... B05B 1/02

[52] U.S. Cl. ..... 239/8; 239/423; 239/427.3; 239/433

[58] Field of Search ..... 239/429, 424.5, 239/424, 423, 416.4, 416.5, 427, 8, 427.3, 433

[56] References Cited

U.S. PATENT DOCUMENTS

| | | | |
|---|---|---|---|
| 1,423,650 | 7/1922 | Decuir | 239/427 |
| 3,004,719 | 10/1961 | Pouppirt | 239/424.5 |
| 3,567,116 | 3/1971 | Lindlof | 239/2 |
| 3,595,480 | 7/1971 | Kunioka | 239/424.5 |
| 4,356,970 | 11/1982 | Vosper et al. | 239/424.5 |
| 4,562,966 | 1/1986 | Smith et al. | 239/433 |
| 4,846,402 | 7/1989 | Sandell et al. | 239/9 |
| 4,893,752 | 1/1990 | Spink et al. | 239/427 |
| 5,014,790 | 5/1991 | Papavergos | 239/424.5 |

FOREIGN PATENT DOCUMENTS

| | | | |
|---|---|---|---|
| 458 685 | 11/1991 | European Pat. Off. . | |
| 2269 502 | 12/1993 | France . | |
| 269 502 | 12/1993 | France . | |
| 3217777 | 12/1983 | Germany | 239/424.5 |
| 91 11 224.9 | 3/1993 | Germany | B05B 7/16 |
| 2001350 | 10/1993 | Russian Federation | 239/419.3 |
| 2 135 905 | 9/1984 | United Kingdom | B05B 1/14 |

*Primary Examiner*—Kevin Weldon
*Attorney, Agent, or Firm*—Curtis, Morris & Safford, P.C.; A. Thomas S. Safford

[57] ABSTRACT

Methods and apparatus particularly useful for atomizing a heavy highly viscous liquid into fine droplets (such as petroleum distillate resid to droplets on the order of 100 thousandths of a millimeter), with the aid of at least one auxiliary gas. This employs in a nozzle head an array of a plurality of primary channels and at least two secondary channels associated with each said primary channel. The primary channels each have an inlet end connected to a high pressure source of liquid, and have an outlet end defining an atomization orifice. The secondary channels each have an inlet end being connected to at least one source of auxiliary gas and an outlet end. The outlets of the secondary channels each intersect with a commonly associated primary channel at the same or different locations upstream of the respective atomization orifice at angles of less than 90°, typically 45° or less. Liquid is passed through a plurality of primary channels thereby forming a liquid core stream. At least one auxiliary gas is injected under pressure into each respective primary channel from at least two secondary channels associated with each primary channel, thereby atomizing the liquid.

25 Claims, 2 Drawing Sheets

METHOD AND APPARATUS FOR ATOMIZING A LIQUID, PARTICULARLY A HIGHLY VISCOUS LIQUID, WITH THE AID OF AT LEAST ONE AUXILIARY GAS

FIELD OF THE INVENTION

The present invention relates to a method and apparatus for atomizing a highly viscous liquid with the aid of at least one auxiliary gas.

BACKGROUND OF THE INVENTION

Although the method and the apparatus according to the invention have been studied particularly for atomizing fuels for purposes of their combustion, they can also be used for atomizing liquids for other applications.

To define the problem, reference shall be made in the following to the combustion of products, particularly fuels, obtained by refining crude petroleum, but the solution contributed by the invention can also be used to solve similar problems, as will be explained in the following description.

As currently practiced, the refining of crude petroleum produces heavy, highly viscous products originating from refinery conversion units.

To achieve good combustion of these heavy products, they must be atomized into fine droplets of very small diameter, of the order of 100 thousandths of a millimeter. It is estimated that to obtain this droplet size, the viscosity of the product must be reduced to less than 20 $mm^2/s$ at the atomization temperature. For products with a viscosity of 4000 $mm^2/s$ at 100° C., the atomization temperature must be 200°–230° C. to reduce the viscosity of the product to about 20 $mm^2/s$ and to achieve good atomization by conventional atomization means.

If the use of excessively high temperatures, are not economically desirable, then to reduce viscosity it has been necessary to partly dilute the heavy, highly viscous products with middle distillates (of which there is a shortage in the refining industry) thus necessitating an increase in the co-production of heavy fuels to obtain the needed extra middle distillates and consequently causing a worsening of the already-existing glut of low-profit heavy fuels.

If one attempts to use the conventional processes at lower temperatures without diluting the fuel, one is forced to use said fuel at a higher viscosity. But such conventional processes using mechanical atomization of a product with a higher viscosity, for example, of 400 $mm^2/s$ at 200° C., would require high pressures on the order of $2\times10^7$ pascals at 200° C. which represents a significant drawback.

In Applicants' Assignee's French Patent Application FR-A-2 662 377, the contents of which are incorporated herein by reference, a co-worker of the Applicants has already proposed more effectively to atomize viscous fuels at a higher viscosity than generally used and, hence, at lower temperatures, by forming in the atomization apparatus a film of the viscous fluid which is then atomized into fine droplets with the aid of two streams of gaseous fluids.

Said prior method comprises the use of an annular stream of said liquid, an annular stream of a primary gas, an annular stream of a secondary gas, identical in content to or different from the preceding one, and consists of a) conducting the liquid stream within said stream of primary gas in the flow direction thereof, b) forming a thin annular film of liquid by conducting the coaxial streams of liquid and primary gas to the periphery of a ring whose one free end is configured in the shape of an annular edge, c) atomizing the liquid at the end of said edge by the combined action of said stream of primary gas and the stream of secondary gas flowing inside the ring in the same direction as said liquid stream and said stream of primary gas.

According to the aforementioned French Patent Application, said method is characterized by the advantage that the ratio of total weight of gas to the total weight of liquid is less than 0.5 and by the primary and the secondary gas streams at the level of the edge being at sonic flow velocities.

Also described in the same French Patent Application is an atomization apparatus for carrying out said method, and the use of said apparatus and said method for atomizing liquid fuels, particularly heavy and highly viscous fuels, for the purpose of their combustion. Air, steam or refinery gas can be used as the gas in the case of fuel combustion and steam in the case of preliminary atomization of said fuel.

One of the Applicants with the same co-worker next developed a simple means for obtaining a homogeneous distribution of liquid droplets, without altering the quality of the dispersion formed by said apparatus from an annular sheet of liquid, which consists of placing at least one obstacle across part of the annular sheet of liquid, causing local breakup of said liquid sheet and thus creating a discontinuity that modifies the trajectory of the droplets.

This latter technique is the subject of Applicants' Assignee's French Patent Application FR-A-2 692 502 (of which Mr. Didier Quevillon is a co-patentee) and the contents of which are incorporated by reference.

Such atomization processes and devices involving the formation of a prefilm, however, have the drawback that the annular space used to obtain the annular stream of liquid usually has, perpendicular to the travel direction of the liquid, a reduced dimension, usually much less than 1 mm, which brings with it a serious risk of plugging by particles suspended in the liquid.

To be able to suppress or limit such risk of plugging, the smallest transverse dimension of the annular space in which the liquid and the auxiliary gases flow should preferably be at least one millimeter.

BRIEF SUMMARY OF THE INVENTION

In view of such dimensional constraints, Applicants have established that it is not possible to effectively fully utilize injectors which form a prefilm, but that systems which use channels for both the flow of the liquid to be atomized and the passage of the auxiliary gas or gases, are desirable to facilitate the realization of a more effective injector system.

One preferred embodiment of the invention described herein is a method for atomizing a liquid, particularly a highly viscous liquid, with the aid of at least one auxiliary gas, whereby the liquid flows in a plurality of primary channels each having an atomization orifice, wherein the auxiliary gas is injected under pressure into the primary channel from at least two lateral secondary channels ending at at least two distinct locations upstream of the atomization orifice. Preferably such channels are circular, or oval in shape with a major/minor diameter ratio of 1 to 4 and more preferably of 1.0 to 1.5.

Gases such as nitrogen, steam, air or a combustible gas may be used for the auxiliary gas.

Another preferred embodiment of the invention is an apparatus for atomizing a liquid, particularly a highly viscous liquid, with the aid of at least one auxiliary gas under pressure, said apparatus comprising a plurality of primary channels supplied with the liquid to be atomized, each of said primary channels having an atomization orifice, and being associated with at least two secondary channels connected to a source of pressurized auxiliary gas, said secondary channels ending in a primary channel at two distinct locations.

The secondary channels may converge toward the same point on the axis of each primary channel from different directions (optically all being within the same plane) and/or may connect to said primary channel at axially-spaced different locations.

Preferably, the axes of the two respective secondary channels form angles with the axis of the primary channel of less than or equal to 90°.

As indicated above, to suppress or limit the risk of plugging, the primary and the secondary channels preferably should have a minimum transverse dimension of at least 1 mm. The channel diameters are preferably 1 to 8 mm, more preferably 1 to 4 mm and, as shown in the examples below, on the order of 2 mm, being most conveniently circular in cross-section.

As set forth below in the description of two examples embodying the invention, the device according to the invention advantageously contains a head with a plurality of primary channels, the atomization orifices of which are regularly distributed on the head of the device in the form of a circular ring or in the form of two coaxial circular rings.

Preferably, the various primary channels are supplied with the liquid to be atomized from a single primary feed line, whereas the various secondary channels are supplied with pressurized gas from a single secondary feed line, for example of annular cross-section and concentric with the primary feed line. Two distinct secondary feed lines can also be used.

BRIEF DESCRIPTION OF THE DRAWINGS

In this specification and the accompanying drawings, we have shown and described preferred embodiments of the invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify the invention in a variety of forms, each as may be best suited to the conditions of a particular use.

Figure 1:
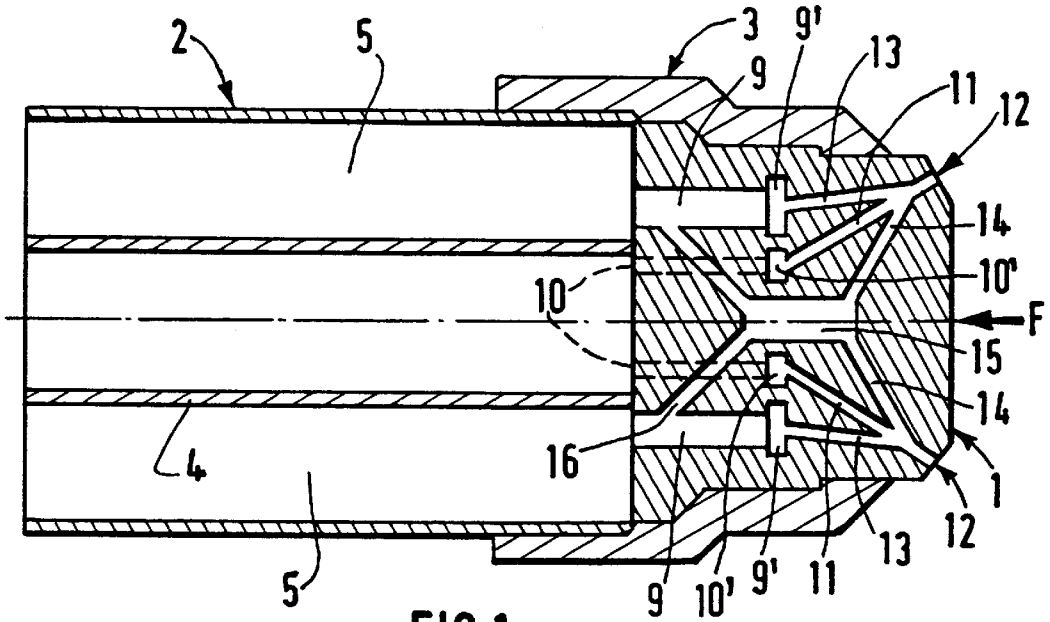
FIG. 1 is an axial cross-sectional view, along line I—I of FIG. 2, of a first embodiment of the apparatus (wherein the atomization orifices are arrayed in a single ring)
Figure 2:
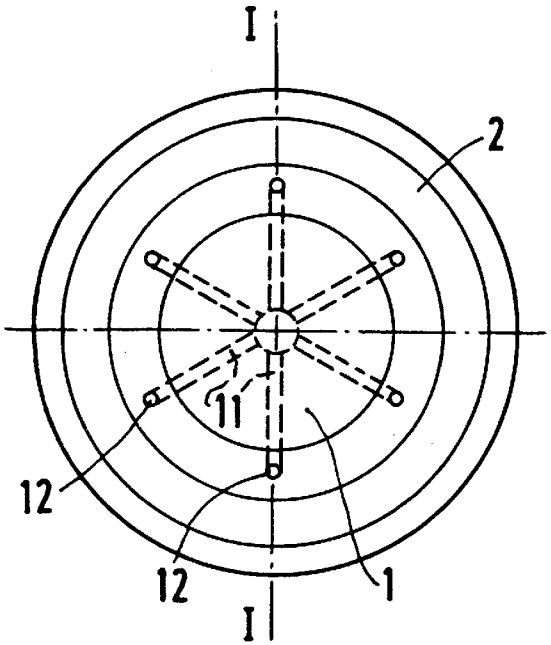
FIG. 2 is an end view in the direction of arrow F of FIG. 1.
Figure 3:
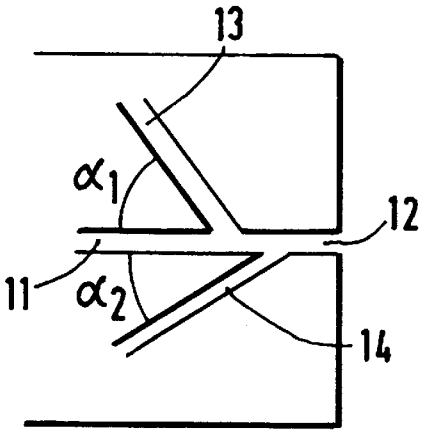
FIG. 3 is a detailed view illustrating in simplified form an example of one type of connection between the primary and secondary channels of the apparatus.

First, reference shall be made to FIGS. 1 to 3.

The apparatus shown comprises an atomization head 1 which is integral with a cylindrical pipe 2 by means of a collar 3, screwed onto pipe 2. In pipe 2, coaxially therewith, is disposed a feed line 4 for the highly viscous liquid to be atomized, whereas the pressurized auxiliary gas used for the atomization flows in space 5 that separates pipe 2 from feed line 4.

For the purpose of simplification, head 1 is shown as consisting of a single piece. For machining purposes, however, said head may be made of several pieces. Such machining is known to those skilled in the art.

In the part of head 1 that is in contact with pipe 2 are provided in parallel with the axis of line 4, on the one hand, channels 9 communicating with space 5 and thus supplied with auxiliary gas and, on the other, channels 10 communicating with line 4 thus feeding the liquid to be atomized.

The other ends of channels 10 communicate through an annular chamber 10' with channels 11, inclined toward the axis of the head and ending outside said axis with atomization orifices 12 for the liquid fed to said channels 11.

Two respective channels 13 and 14 supplied with auxiliary gas from channels 9 end laterally in each of the channels 11 in the immediate vicinity of the latter's orifice 12. The range distances between (1) the respective location of the atomization orifice 12 at the end of its respective primary channel 11 and (2) the intersection of the closest secondary channel 13 or 14 with that of the primary channel 11 at a point upstream of the orifice 12 is preferably 0.5 mm to 1 cm. Channels 13 communicate with channels 9 through an annular chamber 9', whereas channels 14 are connected to an axial channel 15 which communicates with channels 9 through channels 16, inclined toward the axis.

The liquid thus passes successively from pipe 4, through channels 10, 10', and 11, whereas the auxiliary gas flows successively from annular space 5 through channels 9, 9', and 13 to 11, or through channels 9, 16, chamber 15, and on through channels 14 to 11.

As can be seen in FIG. 3, channels 13 and 14 form angles $\alpha_1$ and $\alpha_2$ with channel 11 of less than or equal to 90°. Angles $\alpha_1$ and $\alpha_2$ may be identical or not, being on the order of 45° as illustrated. Channels 13 and 14 can converge toward the same point on the axis of channel 11 or, as shown, can connect with said channel at different locations spaced along the axis of channel 11. The range of axial distances along the primary channel 11 (or 11') between the respective intersections of the two respective secondary channels 13 and 14 (or 13' and 14') associated with the primary channel is preferably 0 to 6 mm.

Figure 4:
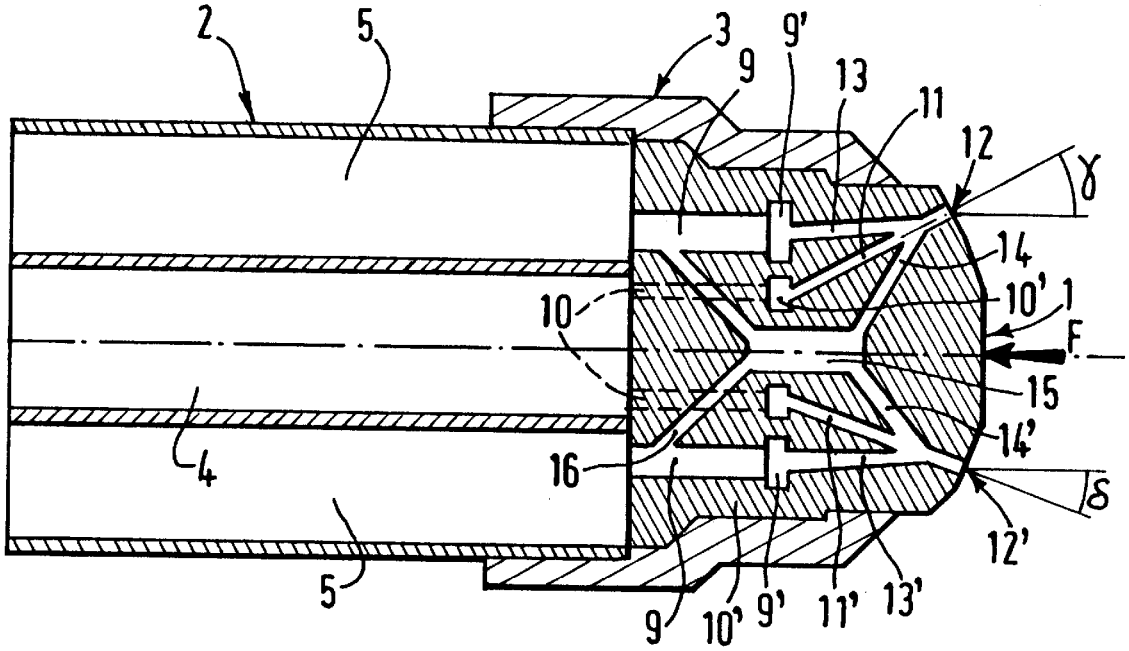
FIG. 4 is an axial cross-sectional view, along line IV—IV of FIG. 5, of a first embodiment of the apparatus (wherein the atomization orifices are arrayed in two concentric rings)
Figure 5:
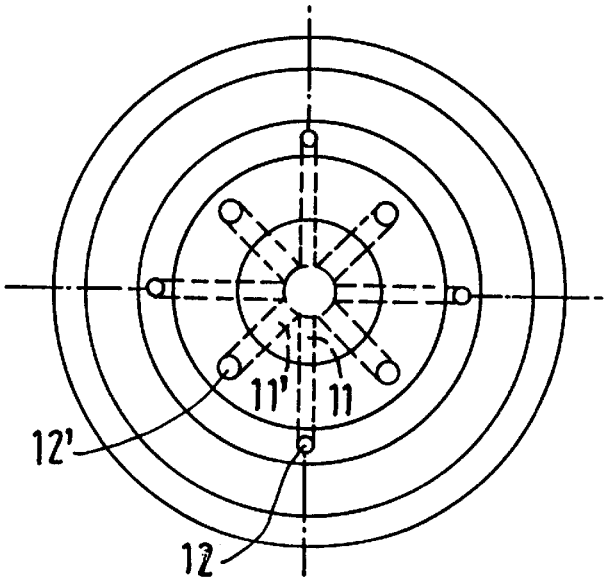
FIG. 5 is an end view in the direction of arrow F of FIG. 4.

FIGS. 4 and 5 illustrate another embodiment of the apparatus according to the invention. In these figures, the elements, where the same, are indicated by the same reference numerals as in FIGS. 1 to 3.

In this embodiment, the atomization orifices of channels 11 are not distributed on the head of the device regularly in the form of a single circular ring, but in the form of two coaxial rings, orifices 12, of which the device shown has four, being displaced by a 45° angle relative to orifices 12'. Orifices 12' are associated with channels 11', 13' and 14', disposed in a manner analogous to that of channels 11, 13 and 14 and performing the same function.

The diameters and the dimensions of channels 11, 13 and 14 can be different from those of their homologs 11', 13' and 14' as can the angles $\gamma$, $\delta$ formed by the axes of the injection orifices with the axis of the device.

The following examples serve to illustrate certain applications of the apparatus described above to the atomization of a highly viscous liquid, namely an oil.

EXAMPLE 1

An apparatus used was of the type represented in FIGS. 1 to 3. It had the following characteristics.

Number of channels 11 and atomization orifices 12: 6

Diameter of channels 11: 1.7 mm

Diameter of channels 13 and 14: 1.7 mm

Angles $\alpha_1$ and $\alpha_2$: 45°

Distance between the points of connection of channels 13 and 14 to channel 11: 0

Distance from said points of connection to orifice 12: 2 mm.

The test conditions were as follows.

Oil

Flow rate of the oil: 33 kg/h, through the atomization orifice pressure of the oil: $9.5\times10^5$ pascals Viscosity of the oil: 200 $mm^2/s$ at 20° C.

Auxiliary fluid: Nitrogen

Pressure of auxiliary fluid: $6.5\times10^5$ pascals

Weight of nitrogen based on oil: 30 wt %

With this highly viscous liquid and under the above-indicated conditions, the Sauter mean droplet diameter at the exit from the device was 35 microns, with 90% of the droplets having a diameter of less than 120 microns and 99% of them having a diameter of less than 290 microns.

EXAMPLE 2

The apparatus used was of the type shown in FIGS. 3 and 4. It had the following characteristics.

Number of channels 11 and 11' and of atomization orifices 12 and 12': 8

Diameter of channels 11: 1.7 mm

Diameter of channels 13 and 14: 1.7 mm

Angles $\alpha_1$ and $\alpha_2$; 45°

Distance between the points of connection of channels 13 and 14 to channels 11: 0

Distance from said points of connection to orifice 12: 2 mm

Angle $\gamma$ formed by channels 11 with the axis of the injector: 30°

Diameter of channels 11': 2.0 mm

Diameter of channels 13' and 14': 2.0 mm

Angles $\alpha_1$ and $\alpha_2$ (for channels 11', 13' and 14') : 45°

Distance between the points of connection of channels 13' and 14' to channels 11': 0

Distance from said latter points of connection to orifice 12': 2 mm

Angle $\delta$ formed by channels 11' with the axis of the injector: 20°

The test conditions were as follows:

Oil

Flow rate of the oil: 33 kg/h through orifices 12; 45 kg/h through orifices 12' pressure of the oil: $9.5\times10^5$ pascals

Viscosity of the oil: $200\times10^{-6}$ $m^2/s$ (200 $mm^2/s$) at 20° C.

Auxiliary fluid: Nitrogen

Pressure of auxiliary fluid: $6.5\times10^5$ pascals

Weight of nitrogen based on oil: 30 wt %.

Under these conditions, the mean droplet diameter at the exit from the device was once again 35 microns, with 90% of the droplets having a diameter of less than 120 microns and 99% of them having a diameter of less than 290 microns.

The above examples illustrate the efficacy of the method and of the apparatus according to the invention when applied to the atomization of highly viscous liquids such as those used as fuels.

We claim:

1. A method for atomizing a liquid, with the aid of at least one auxiliary gas, comprising the steps of:

passing said liquid through a plurality of primary channels, thereby forming in each primary channel a core stream of said liquid, the outlet end of each primary channel defining an atomization orifice, and injecting, under pressure, at least one auxiliary gas into each liquid core stream contained within each of the respective primary channels, from at least two secondary channels associated with each primary channel, each of the secondary channels intersecting an associated primary channel at locations upstream of said atomization orifice with the primary channels each being of uniform diameter a least between the intersection locations and the atomization orifice, and wherein the liquid, having a viscosity well in excess of 20 $mm^2/s$ is at atomization temperatures, is atomized by auxiliary cases under a pressure of less than $10^6$ pascals, at the exit of each atomization orifice, to give a Sauter mean droplet diameter of about 35 microns, with at least ninety percent of said droplets having a droplet diameter of less than 120 microns and at least ninety-nine percent of said droplets having a droplet diameter of less than 290 microns.

2. A method for atomizing a liquid, with the aid of at least one auxiliary gas, comprising the steps of:

passing said liquid through a plurality of primary channels, thereby forming in each primary channel a core stream of said liquid, the outlet end of each primary channel defining an atomization orifice, and injecting, under pressure, at least one auxiliary gas into each liquid core stream contained within each of the respective primary channels, from at least two secondary channels associated with each primary channel, each of the secondary channels intersecting an associated primary channel at locations upstream of said atomization orifice wherein the axis of the closest of the secondary channels connected to an associated primary channel intersects the axis of said primary channel at an upstream location which is at a distance from the atomization orifice along the axis of the primary channel of at least about 0.5 millimeters to about 1.0 centimeter.

3. The method of claim 2, wherein the distance between the furthest separated points of intersection of the axes of the respective secondary channels along the axis of the thus associated primary channel ranges from 0 to 6 millimeters and at least two of said secondary channels intersect the primary channels on opposing sides; wherein the liquid, having a viscosity well in excess of 20 $mm^2/s$ is at atomization temperatures, is atomized by auxiliary gases under a pressure of less than $10^6$ pascals, at the exit of each atomization orifice, to give a Sauter mean droplet diameter of about 35 microns, with at least ninety percent of said droplets having a droplet diameter of less than 120 microns and at least ninety-nine percent of said droplets having a droplet diameter of less than 290 microns; wherein each respective primary channel and secondary channel has a minimum transverse dimension of at least about 1.0 millimeter; and wherein the ratio of the maximum transverse dimension to minimum transverse dimension for each respective primary channel and secondary channel is in the range of 1.0 to 4.0.

4. The method of claim 3, wherein the primary channels are forwardly directed, mutually divergent, and in a regularly spaced array about a common axis.

5. The method of claim 4, wherein there are only two secondary channels associated with and intersecting any one primary channel and the two channels intersect the one primary channel from opposing directions.

6. The method of claim 5, wherein the liquid used is a highly viscous liquid.

7. The method of claim 6, wherein the liquid used is a fuel oil.

8. A method for atomizing a liquid, with the aid of a least one auxiliary gas, comprising the steps of:

passing said liquid through a plurality of primary channels, thereby forming in each primary channel a core stream of said liquid, the outlet end of each primary channel defining an atomization orifice, and injecting, under pressure, at least one auxiliary gas into each liquid core stream contained within each of the respective primary channels, from at least two secondary channels associated with each primary channel, each of the secondary channels intersecting an associated primary channel at locations upstream of said atomization orifice wherein the distance between the furthest separated points of intersection of the axes of the respective secondary channels along the axis of the thus associated primary channel ranges from 0 to 6 millimeters and at least two of said secondary channels intersect the primary channels on opposing sides.

9. A method for atomizing a liquid, with the aid of at least one auxiliary gas, comprising the steps of:

passing said liquid through a plurality of primary channels, thereby forming in each primary channel a core stream of said liquid, the outlet end of each primary channel defining an atomization orifice, and injecting, under pressure, at least one auxiliary gas into each liquid core stream contained within each of the respective primary channels, from at least two secondary channels associated with each primary channel, each of the secondary channels intersecting an associated primary channel at locations upstream of said atomization orifice wherein the liquid, having a viscosity well in excess of 20 $mm^2/s$ is at atomization temperatures, is atomized by auxiliary gases under a pressure of less than $10_6$ pascals, at the exit of each atomization orifice, to give a Sauter mean droplet diameter of about 35 microns, with at least ninety percent of said droplets having a droplet diameter of less than 120 microns and at least ninety-nine percent of said droplets having a droplet diameter of less than 290 microns.

10. An apparatus for atomizing a liquid, with the aid of at least one auxiliary gas, comprising; a plurality of primary channels each having an inlet end connected to a high pressure source of liquid and having an outlet end defining an atomization orifice, and at least two secondary channels associated with each said primary channel, each secondary channel having an inlet end being connected to at least one source of auxiliary gas and an outlet end, with said outlet end of each of the secondary channels intersecting into their commonly associated primary channel at locations upstream of the respective atomization orifice with the primary channels each being of uniform diameter at least between the intersection locations and the atomization orifice, and wherein the liquid, having a viscosity well in excess of 20 $mm^2/s$ is at atomization temperatures, is atomized by auxiliary gases under a pressure of less than $10^6$ pascals, at the exit of each atomization orifice, to give a Sauter mean droplet diameter of about 35 microns, with at least ninety percent of said droplets having a droplet diameter of less than 120 microns and at least ninety-nine percent of said droplets having a droplet diameter of less than 290 microns.

11. The apparatus of claim 10, wherein there are only two secondary channels associated with and intersecting any one primary channel and the two channels intersect the one primary channel from opposing directions.

12. An apparatus for atomizing a liquid, with the aid of at least one auxiliary gas, comprising:

a plurality of primary channels each having an inlet end connected to a high pressure source of liquid and having an outlet end defining an atomization orifice, and at least two secondary channels associated with each said primary channel, each secondary channel having an inlet end being connected to at least one source of auxiliary gas and an outlet end, with said outlet end of each of the secondary channels intersecting into their commonly associated primary channel at locations upstream of the respective atomization orifice wherein the axis of the closest of the secondary channels connected to an associated primary channel intersects the axis of said primary channel at an upstream distance from the atomization orifice along the axis of the primary channel of at least about 0.5 millimeters to about 1.0 centimeter.

13. The apparatus of claim 12, wherein each respective primary channel and secondary channel has a minimum transverse dimension of at least about 1.0 millimeter.

14. The apparatus of claim 13, wherein the ratio of the maximum transverse dimension to minimum transverse dimension for each respective primary channel and secondary channel is in the range of 1.0 to 4.0.

15. An apparatus for atomizing a liquid, with the aid of at least one auxiliary gas, comprising:

a plurality of primary channels each having an inlet end connected to a high pressure source of liquid and having an outlet end defining an atomization orifice, and at least two secondary channels associated with each said primary channel, each secondary channel having an inlet end being connected to at least one source of auxiliary gas and an outlet end, with said outlet end of each of the secondary channels intersecting into their commonly associated primary channel at locations upstream of the respective atomization orifice wherein the distance between the furthest separated points of intersection of the axes of the respective secondary channels along the axis of the their associated primary channel ranges from 0 to 6 millimeters.

16. An apparatus for atomizing a liquid, with the aid of at least one auxiliary gas, comprising:

a plurality of primary channels each having an inlet end connected to a high pressure source of liquid and having an outlet end defining an atomization orifice, at least two secondary channels associated with each said primary channel, each secondary channel having an inlet end being connected to at least one source of auxiliary gas and an outlet end, with said outlet end of each of the secondary channels intersecting into their commonly associated primary channel at locations upstream of the respective atomization orifice, and an atomization head in which the plurality of primary channels are contained and the atomization orifices are disposed regularly in the form of a circular ring about the axis of said atomization head and each primary channel is at a common angle γ to said axis of said head wherein the axis of the closest of the secondary channels connected to an associated primary channel intersects the axis of said primary channel at an upstream distance from the atomization orifice along the axis of the primary channel of at least about 0.5 millimeters to about 1.0 centimeter; wherein the distance between the furthest separated points of intersection of the axes of the respective secondary channels along the axis of the their associated primary channel ranges from 0 to 6 millimeters; wherein the ratio of the maximum transverse dimension to minimum transverse dimension for each respective primary channel and secondary channel is in the range of 1.0 to 4.0; and wherein each respective primary channel and secondary channel has a minimum transverse dimension of at least about 1.0 millimeter.

17. The apparatus of claim 16, wherein the ratio of the maximum Transverse dimension to minimum transverse dimension for each respective primary channel and secondary channel is in the range of 1.0 to 1.5.

18. The apparatus of claim 17, wherein the axis of each secondary channel forms an angle respective to the axis of its associated primary channel of less than or equal a to 90°.

19. The apparatus of claim 18, wherein each secondary channel has a minimum transverse dimension that is equal to or greater than the minimum transverse dimension of its associated primary channel.

20. The apparatus of claim 19, wherein the circumference or each respective primary channel and secondary channel is circular in shape.

21. The apparatus of claim 20, wherein the primary channels are supplied with a liquid from a single liquid feed line and the secondary channels are supplied with auxiliary gas under pressure from at least a single gas feed line, said liquid feed line and gas feed line being concentric in that said auxiliary gas flows in the space of an annular cross section and that respective liquid feed line and gas feed line are each distinct and separate.

22. The apparatus of claim 16, also comprising an atomization head, wherein the plurality of primary channels are contained in said atomization head and She atomization orifices are disposed regularly in the form of a circular ring about the axis of said atomization head and each primary channel is at a common angle γ to said axis of said head.

23. The apparatus of claim 22, wherein each of the axes of each of the secondary channels in said atomization head intersects with the axis of its respective primary channel at a point located within a common plane perpendicular of the axis of said respective primary channel.

24. The apparatus of claim 23, wherein each of the axes of each of the secondary channels in said atomization head intersects with the axis of its respective primary channel at a point located within a common plane perpendicular of the axis of said head.

25. The apparatus of claim 16, also comprising an atomization head, wherein the plurality of primary channels are contained in said atomization head, said primary channels consisting of two sets, each set having different respective transverse dimensions and the atomization orifices of each set being disposed regularly in the form of at least two co-axial circular rings with respect to each set about the axis of said atomization head, and each primary channel of the first set being at a common angle δ and each primary channel of the second set being at a common angle γ relative to said axis of said head.

* * * * *